United States Patent [19]

Chartier et al.

[11] 4,352,436

[45] Oct. 5, 1982

[54] PILFERPROOF CAP

[75] Inventors: Robert M. Chartier, Waterloo; Jean P. Richard, St. Bruno, both of Canada

[73] Assignee: Consumers Glass Company Limited, Etobicoke, Canada

[21] Appl. No.: 211,389

[22] Filed: Nov. 28, 1980

[51] Int. Cl.[3] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 3,329,295 | 7/1967 | Fields | 215/252 |
| 3,463,341 | 8/1969 | Fields | 215/252 |
| 4,241,841 | 12/1980 | Boller | 215/252 |
| 4,278,180 | 7/1981 | Willis | 215/252 |

FOREIGN PATENT DOCUMENTS

| | | | |
|---|---|---|---|
| 1955047 | 5/1971 | Fed. Rep. of Germany . | |
| 1536459 | 7/1968 | France | 215/252 |
| 1581775 | 9/1969 | France . | |

*Primary Examiner*—Donald F. Norton

[57] ABSTRACT

A plastic screw-on closure adapted for use with containers and having provision to indicate when the sealed container closure has been tampered with. The closure has a cap, a band for application over the shoulder of a container, means for connecting the cap and band and drive means for controlling relative rotation of the cap and band as the band is applied over a shoulder on a container. The drive means provides engagement between the cap and band during application of the closure, thereby ensuring the integrity of the connecting means during application of the closure. However, the drive means is ineffective during removal of the cap, such that the connecting means fractures due to axial separation of the cap and band.

20 Claims, 12 Drawing Figures

FIG.7
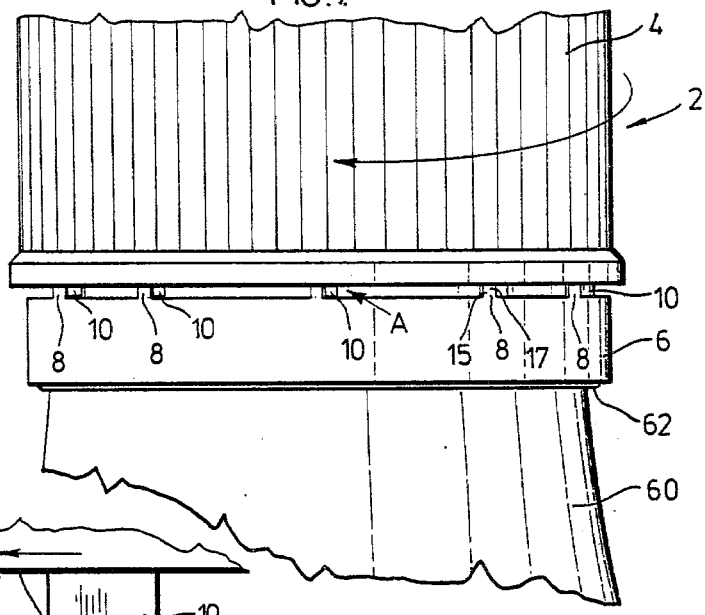
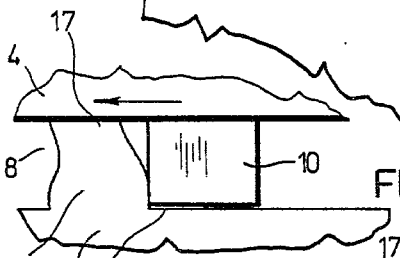
FIG.8.
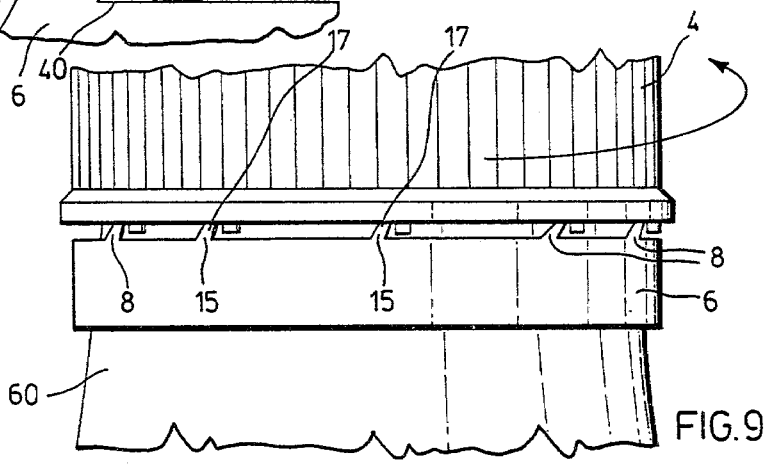
FIG.9.
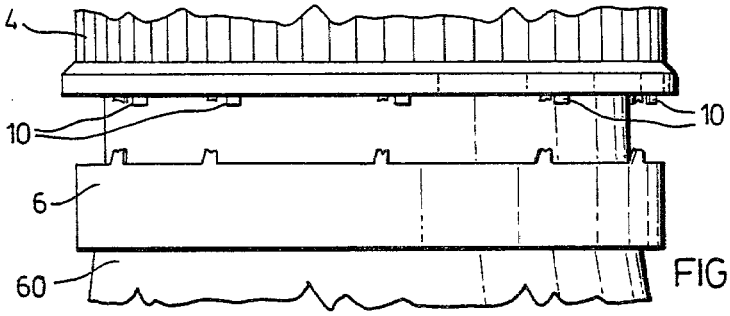
FIG.10.

PILFERPROOF CAP

FIELD OF THE INVENTION

The present invention relates to closures of the type commonly referred to as "pilferproof" or tamper indicating closures having a cap and a depending band connected to the cap by severable connecting means. The band is adapted to snap over the shoulder of a container and engage the shoulder upon removal of the closure such that at least a portion of the connecting means severs when the cap is unscrewed from the container. Thus the condition of the connecting means provides a visual indication of the condition of the contents of the container. More particularly, the invention provides means for ensuring connecting means integrity during application of the closure to a container to provide a tamper indicating or pilferproof band.

BACKGROUND OF THE INVENTION

Various types of closures have been designed to provide a visual indication to the end consumer that the contents of the container have remained sealed and have not been tampered with. In the liquor industry, paper seals in the form of excise stamps are often applied over a screw-on cap so that the paper seal must be broken to gain access to the container. In the wine industry, it is common to provide a wrapping of foil about the neck and mouth of a bottle or in some instances, the use of a plastic oversleeve provides this visual indication that the contents are as originally packaged. The market has widely accepted the concept of providing a guarantee seal however, this often requires an additional packaging step leading to higher production costs.

To alleviate this problem, several types of metal closures such as that disclosed in U.S. Pat. No. 2,367,317 which issued to J. W. Thomas, Jan. 16th, 1945, have been proposed which have a screw on cap portion and a depending pilferproof band which is secured to the cap by a number of severable bridges. With that system the cap is normally a sleeved blank made of aluminum and during application to a threaded glass bottle, the metal sleeve is crimped in position to snugly adhere to the neck portion of the bottle. Closures of this type have gained wide acceptance in the beverage industry, particularly, the liquor and softdrink sector, however, they require sophisticated capping equipment.

A number of designs have been proposed to manufacture a pilferproof closure of the type having a cap and a depending pilferproof band which is made of a plastic material with the pilferproof band adapted to snap over the shoulder provided on a container. In contrast to the metal closures described above, the caps are injection molded prior to container application with the threads and the undercuts for maintaining the band on a container. The closure is subsequently screwed on the neck of a container without further production steps. An example of this type of closure is U.S. Pat. No. 3,708,041 which issued to Birch, Jan. 8th, 1974. However, caps of this design have proven unsatisfactory due to their unrealibility in the band separating from the cap during application to a container. For example, with glass containers, a substantial tolerance variation can occur. Therefore, closures of this type have not proven to be reliable in providing a visual indication that the contents of the container have not been tampered with. When the tolerance on the shoulder provided on a container is near its maximum, application of the closure results in a fairly high frictional force as it is attempted to force the band over the shoulder with the result that the interconnecting bridges may all be severed or a number of them severed during the capping operation. Further problems such as buckling of the band above the shoulder or splitting of the band may also result.

The structure of U.S. Pat. No. 4,033,472 which was assigned to Albert Obrist, overcomes the above problems by providing a plastic closure which is screwed over the mouth of a glass container with the pilferproof band subsequently heated and deformed beneath a shoulder on the container. Such a system overcomes the problems of buckling of the pilferproof band and/or severance of the interconnecting bridges during application. It requires, however, an additional process step which is difficult to control. In addition, the deforming of the band beneath the container shoulder can result in a mis-shapened, distorted band which is not attractive from a marketing standpoint.

The present invention seeks to mitigate a number of problems of the prior disclosures and devices by providing a plastic closure which is simple to apply during the capping operation while maintaining its pilferproof feature.

SUMMARY OF THE INVENTION

The plastic cap of the present invention for twist application to a container has a cap body portion, a band for application over a shoulder provided on a container, means for connecting the cap body portion and band and means for controlling relative rotation of the cap body portion and band as the band is applied over a shoulder of a container during screwing of the cap onto a container.

By controlling the relative rotation of the cap and band during application, the integrity of the connecting means is ensured such that afterwards its condition provides a visual indication whether the contents of the container have been tampered with. The means for controlling relative rotation of the cap and band when the closure is applied to a container is such that it is activated by movement of the band towards the cap which is a result of the natural tendency of the band to resist the deformation necessary for snapping the band beneath the shoulder on a container.

As one can appreciate, from the description of the prior devices, tolerance variations in both the closure and the container to which it is applied is one of the problems which arises. This problem normally becomes acute when the closure is at the minimum tolerance and the container is at the maximum tolerance. In this condition, the force opposing the snapping of the band beneath the shoulder of a container is greater and, according to this invention, the increased force increases the efficiency of the means for controlling and limiting the rotation of the cap relative to the band thereby allowing the band to be forced over the shoulder without premature severance of the connecting means.

According to an aspect of the invention, the severable means for connecting the band to the cap may be in the form of a plurality of severable bridges which connect the band to and axially space it from the cap.

According to another aspect of the invention, the means for controlling relative rotation of the cap and band comprises a number of drive members integral with the cap and extending downwardly to engage the band after a predetermined movement of the band towards the cap during application of the closure.

According to a further aspect of the invention, the drive members are paired with the bridges and located such that during application of the closure, rotational movement of the band relative to the cap, is limited due to inter-engagement of a number of said drive members and a portion of the associated bridges. In this case, the area of the bridge that engages with the drive means, may be of increased cross section to redistribute the force exerted on the bridges to avoid premature fracturing of the thinner bridge section even with high speed capping operations.

The present invention provides a simple structure which adjusts according to the actual dimensions of the closure and associated container to ensure the connecting means does not prematurely fracture during application of the closure. Such a system is required to be functional during application of the closure without adversely influencing the required force for breaking of the connecting means during removal of an applied closure. The closure according to the present invention provides a simple structure which assures consistent results in applying the closure to the container as well as providing the necessary feature that at least a portion of the connecting means severs upon removal of the closure. Due to the ability to preform the tamper indicating portion of the cap, the band portion can be formed to provide an attractive external appearance and thus enhance the marketability of the capped container and contents.

BRIEF DESCRIPTION OF THE DRAWINGS

Preferred embodiments of the invention are shown in the drawings wherein:

FIG. 7 is a side view of the exterior of the cap during application to a container prior to the band snapping over the shoulder, FIG. 8 is an enlarged view of the bridge and drive member of FIG. 7 shown as segment A, FIGS. 9 and 10 are partial side views illustrating the pilferproof band and cap during removal of the cap from a container.

DETAILED DESCRIPTION OF THE PREFERRED EMBODIMENTS

Figure 6:
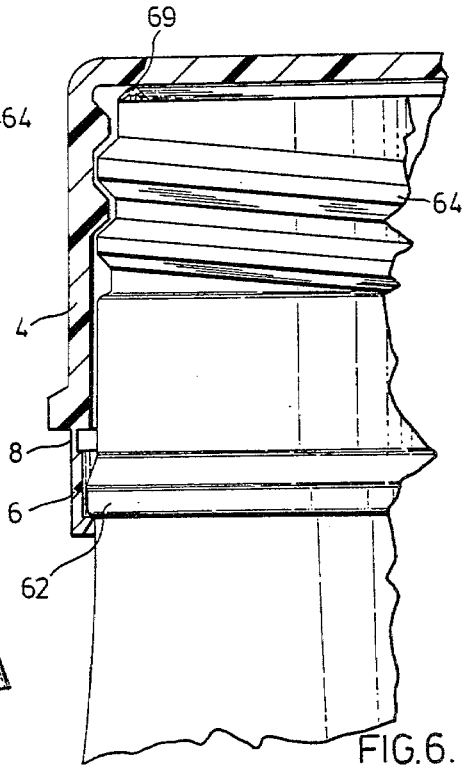
FIG. 6 is a partial side view showing the closure applied to the neck of a container.

The closure generally shown as 2 in the Figures, comprises a cap body portion 4 and a depending pilferproof band 6. Means is provided in the preferred form of bridges 8 to secure or to connect the band to the cap and axially space these two components. The container 60 has been provided with a shoulder 62 which in engaging band 6 causes at least a number of bridges 8 to fracture on removing the cap. Threaded portions 64 of the container maintain the closure on the container and allow twist application and removal of the cap portion 4. As with all closures of this type, the cap portion 4 is adapted on its inside to seal the mouth 66 of the container. The threaded portion 64 in combination with the threads provided on the inner portion of cap 4, assure that the formed seal is maintained. Various well known types of seals may be used with or on the cap, such as liner inserts or various forms of fin seals. According to this embodiment, a triple fin seal 69, as shown in FIG. 6, is used which engages the container rim to form a seal completely therearound.

Figure 1:
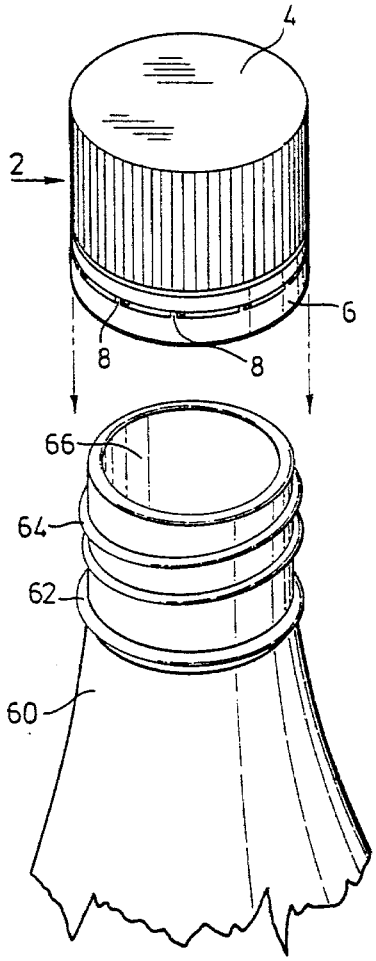
FIG. 1 is an exploded perspective view showing the closure in preparation for application to a threaded neck of a glass bottle.
Figure 2:
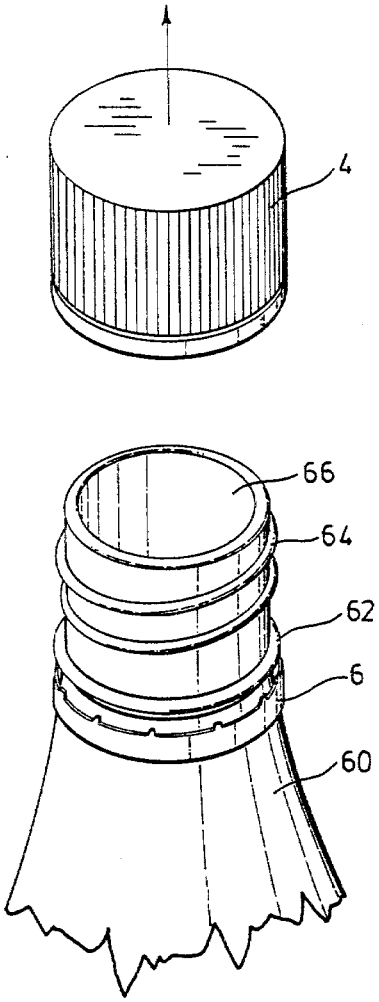
FIG. 2 is a perspective view showing the cap and severed pilferproof band after removal from a container.

As shown in FIG. 2, the cap has been removed from the container 60 and the bridges 8 have severed or broken, due to the upward force exerted on the bridges as the cap is unscrewed while the band is constrained by interaction of the band undercut against shoulder 62. It can be appreciated that the condition of the bridges reflects whether the container has been opened and provides a simple visual indication to the consumer that the seal, provided during packaging of the product, has not been broken.

Figure 3:
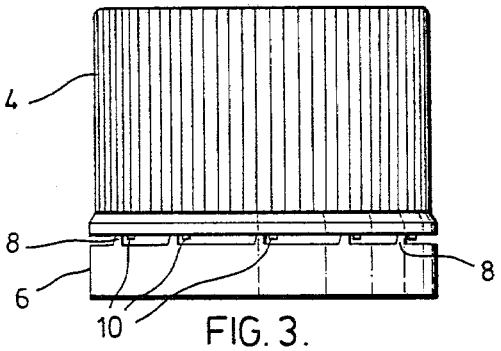
FIG. 3 is side view of the closure prior to application to a container.
Figure 5:
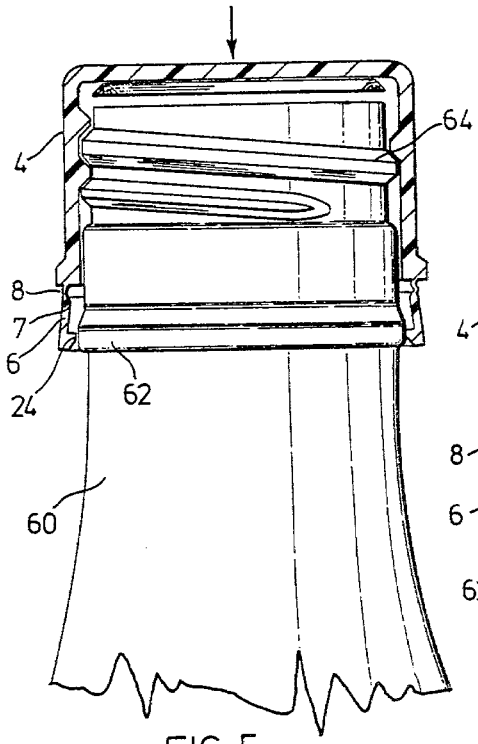
FIG. 5 is a sectional view showing the closure during application to a container.

As shown in FIG. 3 the outer periphery of the cap has corrugated gripping surface to facilitate twist removal of the closure. Each of the bridges 8 has been paired with a drive 10 which is secured to the cap 4. These drives are not of sufficient height to contact the band 8 in the condition shown in FIG. 3, however, during application of the closure, as shown in FIG. 5, these drive members engage the band 6 and assist in limiting the amount of rotation of the band relative to the cap as the band is being applied over shoulder 62. These short drive members may be easily formed during the injection molding operation adjacent bridges 8.

Figure 4:
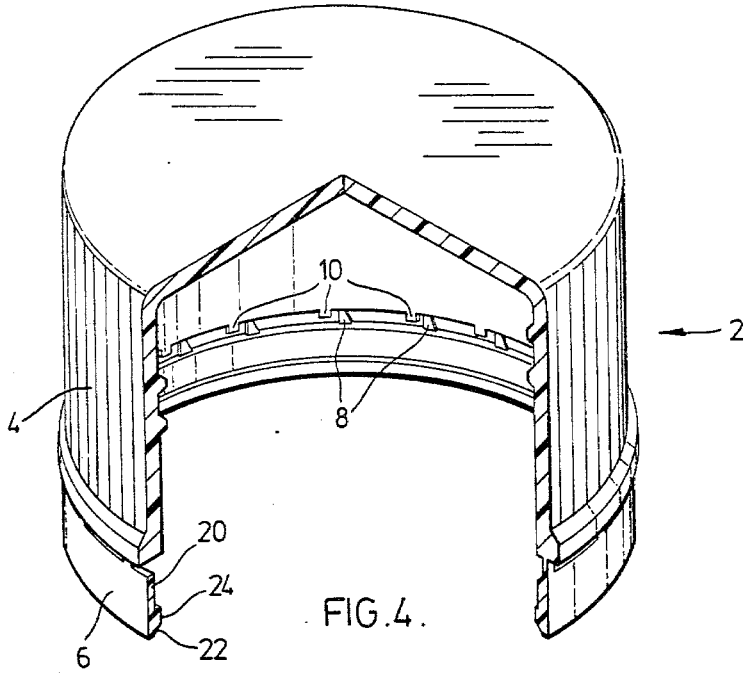
FIG. 4 is a partial perspective view with a portion of the cap removed illustrating the inter-relationship between drive elements secured to the cap and associated bridges.

According to FIG. 4, it can be seen that the individual bridges 8 secure the cap 4 to the band 6 and keep the band and the cap essentially aligned. It can also be seen that the bridges 8 are tapered inwardly from the widest point at the junction with the band 6, to the point of junction with the cap. Also, the drives 10 have been spaced behind the bridges with respect to the direction in which the closure is screwed on a container and project downwardly from the cap 4 but do not extend or join with the band 6. The band has been provided with a sloped surface 22 to ease the application of the closure over shoulder 62 of the container and has an abutment or undercut ledge 24 for snapping beneath the shoulder during screwing of the closure onto the container. The thin sidewall 20 of the band extends upwardly from the ledge 24 and may snugly contact the exterior edge of the shoulder 62 when the closure has been applied. It has been found that in the band snugly contacting the exterior of the shoulder 62, this ensures that ledge 24 hugs the underside of shoulder 62. This is particularly useful in removal of the cap, because a snug contact assists in preventing a portion of the ledge of the band slipping over an area of the shoulder to ensure that the band stays on the container when the cap is taken off the container.

As is apparent from a review of FIGS. 5 and 6, surface 22 provides a camming action in leading the pilferproof band over the shoulder, whereas ledge 24 forms an essential right angle with sidewall 20 and firmly grips beneath the lower portion of the shoulder 62. Similarly, shoulder 62 has been shaped to ease application of the pilferproof band over the shoulder while providing a distinct undercut at the lower edge of the shoulder to assist in maintaining the band beneath the shoulder after application of the closure. With this arrangement, the bridges encounter less strain during application than in removal of the closure.

In FIG. 7, the closure 2 is illustrated as partially applied to the container 60 with the pilferproof band engaging the upper surface of shoulder 62 as it cams against surface 22. The rotational movement of cap 4 and the engagement of lead in surface 22 with shoulder 62 have caused movement of the band towards the cap such that the drive members 10 are now engaging the upper surface of the band 6. Furthermore, due to the frictional drag of the band with the shoulder 62, some relative rotation of the cap and band has taken place causing the leading edge of drive members or teeth 10 to contact the lower trailing edge of the associated bridge 8.

Further rotation of the cap is transmitted to the band 6 by the drive members 10 engaging the thickened portion 15 of the associated bridges such that the thin area of the bridge 17 which is located adjacent the junction of the bridge with the cap, no longer has to withstand the entire force exerted on the bridges due to the drag of the band. A large portion of this force is directly transmitted to the band through the thickened portion of the bridge and the drive members 10. With further rotation of the cap, the force for snapping the band over shoulder 62 causes increased movement of the band towards the cap which enhances a biting action of the drive members on the band and the bridges. These drive members contact the area of the band below it as well as engage the thickened portion of the bridges. The sidewalls 7 of the band have sufficient axial strength to allow ledge 24 to snap over shoulder 62 without buckling to ensure consistent results.

As shown in FIGS. 7 and 8, the drive members have been located behind the bridges with respect to the direction of application of the closure and are spaced somewhat from the bridges to facilitate molding of these components. However, the spacing between the bridges and the drive members is preferred to be as close as possible without causing undue problems in the molding of the components. Where the space between the bridge and the drive members is greater than that shown in the drawings, the movement of the cap towards the band may cause the drive members 10 to engage with the upper surface of the band and bite into the band to prevent premature breaking of the bridges during application of the closure.

FIG. 8 illustrates the biting action of a drive member 10 and the relationship of this drive member with an associated bridge 8. The movement of the cap towards the band has caused drive member 10 to engage the band 6 and cause an area of deformation 40 in the band. The cap has rotated relative to the band causing the bridge 8 to deform until the trailing edge of the bridge 8 abuts the leading edge of drive member 10. The bridge 8 normally buckles due to the movement of the cap towards the band however, the area of increased cross section 15 is of greater strength and firmly engages the drive 10 thereby limiting the degree of relative rotation of the cap and band. Therefore, the drive members 10 ensure bridge integrity by either engaging the associated bridges after a predetermined movement of the cap and band or by biting into the band immediately below the drive members or a combination of the two. In the preferred embodiment of FIG. 8, both actions are taking place. As a result, the drives serve to transmit the torque exerted on the cap to the band to continue the rotation of the band as it snaps over the shoulder of the container.

Depending on the exact dimensions of the closure and that of the glass container, a wide range of possible combinations of closure sizes and container sizes are possible and in some circumstances, the force for snapping the band beneath the shoulder of a container will require minimum assistance from the drive members 10 engaging either the top of the band and/or the thickened portion of the bridges to successfully snap the band ledge over the shoulder. However, in other circumstances, for example, when the closure is at its smallest dimension and the diameter of shoulder 62 is at its largest tolerance, the force required to apply the band over the shoulder will be greater and this will result in further compression of the space between the upper portion of the band and the lower portion of the cap. This compressive movement results in increased biting action of the drive members 10 to thereby ensure that the thinner portions of bridges 8 do not fracture during application of the closure.

Although, each of the bridges have been provided with an associated drive member, in some cases, all of these drive members may not function. For example, accurate control on the shape of the shoulder 62 is not always possible for example, with glass finish, and this surface may depart from its preferred circular section and in fact, be oval or egg shaped. This variation in shape may cause slight side shifting of the band relative to the cap during application of the closure. However, because each of the bridges have been provided with an associated drive member, a large number of these drive members are functional and provide the necessary interaction to ensure bridge integrity during application of the closure.

As previously mentioned, the drive members, which ensure that the band rotates with the cap as the band is being forced over the container shoulder, are particularly useful in applying caps to container finishes which may vary considerably in their dimensions. It is appreciated, however, that this type of cap is useful on various types of containers which may be made of glass, metal, plastic and other suitable materials. For example, in considering glass finishes, variations in the glass finish, such as those of softdrink and liquor bottles, may be as much as 20 thousandths of an inch. Whereas the tolerance on the interior dimensions of the closure are much more accurate, within approximately five thousandths of an inch. This invention, therefore, provides a tamper indicating system which permits its use with containers having a variation in bottle neck dimensions. The drive device of the system maintains the connecting means which may be in the form of bridges in unbroken condition during application of a cap to a container having these variations in dimensions.

FIGS. 9 and 10 illustrate removal of the cap portion from a container, both before and after, severance of the bridges 8. In FIG. 9, the cap has only been rotated approximately twenty-five degrees and the threads of the bottle in combination with the threads on the interior of the cap portion have caused both an upward movement of the cap relative to the band 6 as well as a rotational movement of the band relative to the cap. Further rotation of the cap portion increases the axial separation of the cap from the band thus continuing to stretch the bridges 8 due to band ledge 24 interacting with the undercut of shoulder 62 on the bottle. This in combination with further relative rotational movement of the cap and band will eventually cause the bridges to break at thinned portion 17. Ledge 24 located in the lower portion of the band, firmly engages shoulder 62 of the closure and is of sufficient strength to cause the band to be retained on the glass finish, during removal of the cap. It can further be appreciated that because the drives 10 are located behind the bridges they are inoperable and have no affect in removing the cap such that the bridges are exposed to the combined forces due to vertical separation of the cap and band as well as rotational movement of the cap relative to the band.

Ledge 24 and shoulder 62 have been shaped to provide positive engagement during removal of the closure minimizing any tendency for ledge 24 to cam outwardly over the shoulder. The band has been thickened adjacent ledge 24 to have sufficient strength to withstand the hoop stress encountered during removal of the closure or at least until a number of bridges have severed.

It is, of course, appreciated that the relationship of the band ledge 24 relative to the sealing surface 69 of the cap is designed to ensure that, on cap removal, the connecting bridge portion 8 begins to stretch and perhaps sever before the seal 69 is completely broken. The purpose of this arrangement is particularly suitable where tampering must be indicated when the contents are subject to spoiling or degradation once exposed to air. Thus, the arrangement is such that, as soon as the seal is broken allowing air to enter, for example a vacuum packed bottle, the bridges have been sufficiently stretched or broken to indicate that the container has been tampered with. It is also understood that, in situations where exposure of the contents to air is not critical, then the relationship of the band to the sealing surface may be somewhat more lenient, which in some circumstances would allow breaking of the seal before the band bridges have been broken.

Therefore, the drive members of the present invention assist in transmitting forces encountered during application of the closure to ensure bridge integrity during application of the closure. During removal of the cap from the container, drive means are ineffective such that the bridges sever and prodide a visual indication that the contents of the container have been opened. Furthermore, this drive means allows the bridges to have a tapered cross section such that the drive members engage the thickened portion of the bridges due to movement of the cap towards the band during application of the closure. This allows direct transmission of the forces between the cap and the thickened portion of the bridges while protecting the area of reduced section of the bridges which will sever, upon removal of the cap.

Figure 11:
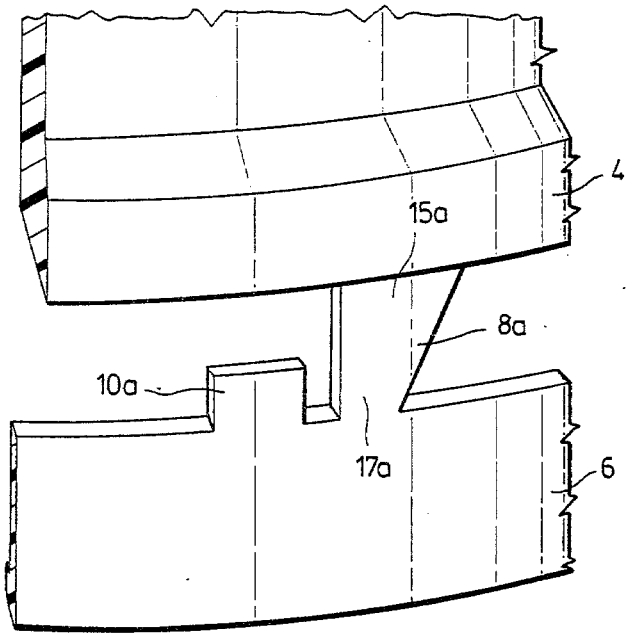
FIG. 11 is an enlarged section of an alternate structure illustrating a portion of the band and cap with the drive means secured to the band prior to application to a container, and, FIG. 12 shows the alternate structure of FIG. 11 during application of the closure.
Figure 12:
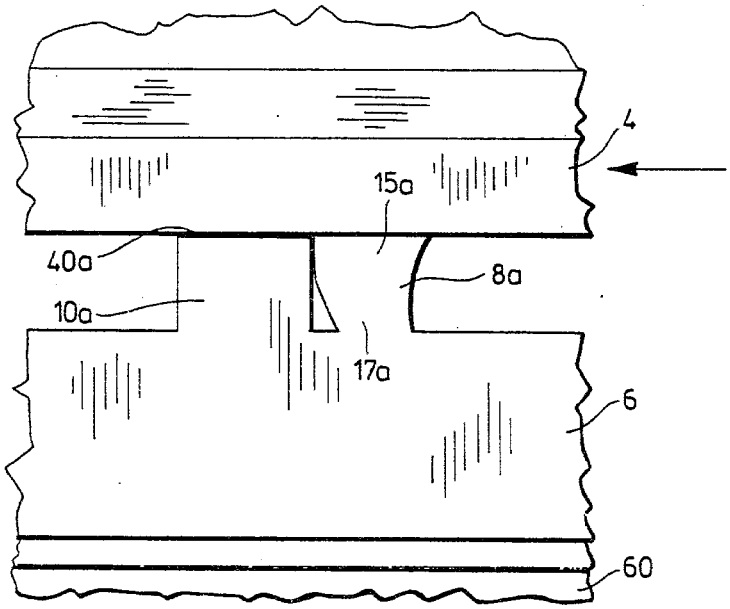

The alternate structure shown in FIGS. 11 and 12 incorporates drive members secured to the upper portion of the pilferproof band forward of the bridges with respect to the direction of application of the closure. Because the drives are now located on the band, the thickened portions of the bridges are located abjacent the lower portion of the cap such that during application of the closure, the drive members engage the thickened portion thereby protecting the thin portion of the bridges.

As shown in FIG. 11, the drive 10*a* projects upwardly from band 6 and is spaced forward of bridge 8*a*. The drive is essentially short and stubby to have sufficient structural strength to positively engage the cap, as shown by deformation 40*a* in FIG. 12 and/or provide positive engagement with the thicker portion 15*a* of the bridges.

In FIG. 12 the closure is shown during application to a container 60 and the band has been forced to move upward such that the drive 10*a* is biting into the cap as shown by deformation 40*a* and some rotation of the cap has occured as the deformed bridge 8*a* is contacting drive 10*a*. Further twist application of the cap will be transmitted to the band by drive member 10*a* due to its interengagement with the thickened portion 15*a* of the bridge and its engagement with the lower portion of the cap. The specialized shape of the bridge provides a simple method for controlling the force required to break them. Furthermore, the area of reduced cross section 17*a* deforms more readily, allowing thickened portion 15*a* to remain aligned with drive 10*a*, to provide engagement during application of the closure.

In some circumstances, for example, where the upper portion of the band is not as thick as the adjacent lower portion of the cap, it is preferred that the drive members be secured to the cap to ensure efficient biting of the drive members with the band. In the preferred embodiments shown in the drawings, the drive members have been paired with associated bridges such that the rotational movement of the cap relative to the band is resisted due to the interaction of the drive members with the lower portion of the band when the drive members are secured to the cap and due to the engagement of the drives with the thickened portion of the bridges. However, in some circumstances, it may not be necessary to pair these drives with the bridges as the individual biting action of the drives with either the band or the cap will be sufficient to ensure bridge integrity during application of the closure.

The present invention utilizes the inherent properties of a plastic which allows a fairly high degree of localized deformation without permanent damage. However, the particular shape of the closure and the pilferproof band utilizes these features during application of the closure in applying ledge 24 over the shoulder on a container while trying to minimize the effect of this property in maintaining the band on the container. The precise plastic selected for forming this closure will vary according to the application however, various thermoplastic materials, such as polyethylene and polypropylene have been found particularly useful with glass containers designed for the liquor industry.

Polypropylene is less deformable than some other plastics such as polyethelene however, it has proven to be quite acceptable. Furthermore, after molding, it exhibits an aging characteristic where the material becomes more brittle and less elastic. Because of this aging problem and the uncertainty in knowing when a closure will be used, it would seem this material would not function satisfactorily however, in actual practice, it has proven quite useful. The drive means limits the forces exerted on the more brittle bridges during application of the closure and prevent premature fracture of the bridges. When polyethylene is used, the closure is more deformable and the bridges can undergo increased deformation without breaking. Furthermore, the plastic is not as rigid as polypropylene and there is a greater tendency for the band to slide over the shoulder of a container when it is removed. To overcome this problem, the area of reduced bridge cross section 17 may be made smaller to fracture more readily while the drive members protect this thinned area during application of the closure.

It is appreciated that other plastics may be used, such as copolymers of the polyethylene/polypropylene type. In addition, mechanical blends of various polymers may be used, such as a combination of polyethylene and polypropylene. Various grades of these plastics may be used in the caps depending upon their end uses, such as, consideration for the strength requirements in the caps as used under pressure or vacuum. Depending upon the selection of a particular plastic, alterations may be required in the shape of the bridges or means for connecting the band to the cap and in the location and shape of the drives for ensuring that the band rotates with the cap, as the band is being forced over the larger part of the shoulder on a container.

In view of the above detailed description of certain aspects of the invention, it can be appreciated that with the control on band movement when the cap is being applied to a container. A broader scope in variations of container tolerances, selected cap plastic compositions and bottle capping mechanisms can be accommodated.

Although the preferred embodiments of the invention have been described herein in detail, it will be understood by those skilled in the art that variations may be made thereto, without departing from the spirit of the invention or the scope of the appended claims.

The claims of the invention in which an exclusive property or privilege is claimed are defined as follows:

1. A plastic cap with tamper indicating provision for twist application to a container, comprising a cap body portion, a band for application over a shoulder provided on a container, a plurality of circumferentially spaced-apart bridges for connecting and axially spacing apart the cap body portion and band, said bridges being sufficiently weak to break readily upon unthreading of the cap body portion for removing such applied cap from a container, means for driving said band relative to said cap body portion as said cap is twist applied onto a container to control relative rotation of said cap body portion and band to ensure integrity of said bridges as said band is applied over a shoulder of a container, said drive means being normally disengaged, said bridges being thickened at their juncture with either the cap or the band and said drive means being associated with the other of said cap or band, said bridges in the area of their thinner portions flexing as said cap is twist applied to a container whereby said band moves towards said cap body portion during application of said cap to a container to engage said drive means with the thickened portions of the bridges to prevent any further relative rotation between band and cap body portion and thereby ensure the integrity of said bridges.

2. A cap as claimed in claim 1 wherein the cap material is selected from the group of plastic materials consisting of polyethylene, polypropylene and copolymers thereof.

3. A cap as claimed in claim 1, wherein said control means comprises a number of drive members secured to said cap body portion and extending downwardly to engage said band after sufficient movement of said band towards said cap body portion during application of said closure.

4. A cap as claimed in claim 1, wherein said control means comprises a number of drive members secured to said band and extending upwardly to engage said cap body portion after sufficient movement of said band towards said cap body portion during application of said closure.

5. The invention as claimed in claim 1, wherein the band comprises a sidewall portion, a ledge projecting inwardly from said sidewall portion for cooperating with a shoulder on a container and a bottom portion having an outwardly flared lower surface for camming said ledge over a container shoulder during application of the closure.

6. The invention as claimed in claim 1, wherein the band comprises a sidewall portion, said sidewall portion circumferentially contacting a container shoulder.

7. The invention as claimed in claim 1, wherein the band is sized to snuggly engage a shoulder provided on a container after application of the closure.

8. A plastic cap with tamper indicating provision for twist application to a container, comprising a cap body portion, a band for application over a shoulder provided on a container, a plurality of bridges for connecting and axially spacing the cap body portion and band, a plurality of drive members secured to said cap body portion and extending downwardly to engage said band after sufficient movement of said band towards said cap body portion during application of said closure, said bridges having an area of increased cross-section adjacent the junction point with said band, said drive members being paired with said bridges and positioned behind said bridges with respect to the rotational direction of application of the cap, such that during application of said cap, rotational movement of said band relative to said cap body portion is limited due to interengagement of a number of said drive members and the area of increased cross-section of associated bridges as said band means moves towards said cap body portion, said interengagement of said drives with said bridges ensuring integrity of said bridges as the band is applied over a shoulder of a container.

9. A cap as claimed in claim 8, wherein said bridges are tapered to define a weak area for fracture of each of said bridges during removal of said cap body portion from a container, said weak areas being protected by said drive members during application of said cap to preclude premature breaking thereof.

10. A cap of claim 9, wherein the narrower portions of said bridges flex during application of said band over a container shoulder, the bridges in so flexing permitting movement of said band toward said cap to cause said drive members to engage the thicker portions of said bridges in controlling the degree of relative rotation between cap and band to protect the weaker thinner bridge portions during cap application to a container.

11. A plastic cap with tamper indicating provision for twist application to a container, comprising a cap body portion, a band for application over a shoulder provided on a container, a plurality of bridges for connecting and axially spacing the cap body portion and band, a plurality of drive members secured to said band and extending upwardly to engage said cap body portion after sufficient movement of said band towards said cap body portion during application of said closure, said bridges having an area of increased cross-section adjacent the junction point with said cap body portion and said drive members are paired with said bridges such that during application of said cap rotational movement of said band relative to said cap body portion is limited due to interengagement of a number of said drive members and the area of increased cross-section of associated bridges as said band moves towards said cap body portion, said interengagement of said drives with said bridges ensuring integrity of said bridges as the band is applied over a shoulder of a container.

12. A cap as claimed in claim 8, 11 or 9, wherein the cap material is selected from the group of plastic materials consisting of polyethylene, polypropylene and copolymers thereof.

13. A cap as claimed in claim 11, wherein said bridges are tapered to define a weak area for fracture of each of said bridges during removal of said cap body portion from a container, said weak areas being protected by said drive members during application of said cap to preclude premature breaking thereof.

14. A cap of claim 13, wherein the narrower portions of said bridges flex during application of said band over a container shoulder, the bridges in so flexing permitting movement of said band toward said cap to cause said drive members to engage the thicker portions of said bridges in controlling the degree of relative rotation between cap and band to protect the weaker thinner bridge portions during cap application to a container.

15. A cap as claimed in claim 10, 13 or 14, wherein the cap material is selected from the group of plastic materials consisting of polyethylene, polypropylene and copolymers thereof.

16. A screw-on plastic closure in combination with a container, said container having a mouth for emptying of the contents of the container, said mouth having exterior threads for cooperating with said plastic closure to allow closure of the container, said container further including an annular shoulder below the threaded mouth of the container, said closure comprising a threaded cap, a band having a sidewall, a lower inwardly directed ledge for engaging the band under said container shoulder upon removal of the cap, a plurality of bridges securing and axially spacing said cap and band, and means for controlling the relative rotation of the cap and band to ensure bridge integrity as the band is applied over the shoulder of said container, during application of the closure said inwardly directed ledge contacts the shoulder of the container, said bridges being thickened at their juncture with one of the cap and band and said control means being associated with the other of said cap and band, said bridges in the area of their thinner portions being sufficiently weak to permit movement of the cap towards the band, as caused by the band ledge contacting the container shoulder, to activate said means for controlling relative rotation to engage said bridge thickened portions, whereby continued twist application of the cap forces the ledge over the shoulder of the container to snap the ledge beneath the shoulder, and upon twist removal of the cap, said ledge engages said shoulder causing at least a number of said cap bridges to break with axial separation of said cap and band.

17. A plastic closure in combination with a container as claimed in claim 16, wherein said closure is made of a polypropylene.

18. The combination as claimed in claim 16 or 17, wherein the lower surface of said ledge is flared outwardly to provide a lead in for application of the ledge over the shoulder of the container.

19. The combination as claimed in claim 16 or 17, wherein the shoulder and ledge are shaped to facilitate ease of twist application of the ledge over the shoulder while providing abutting surfaces to oppose removal of the band over the shoulder.

20. The combination as claimed in claim 16 or 17, wherein said band is maintained on said container during removal of the cap.

* * * * *